US011473590B2

(12) United States Patent
Liu et al.

(10) Patent No.: US 11,473,590 B2
(45) Date of Patent: Oct. 18, 2022

(54) FAN

(71) Applicants: Inventec (Pudong) Technology Corporation, Shanghai (CN); INVENTEC CORPORATION, Taipei (TW)

(72) Inventors: Tang-An Liu, Taipei (TW); Chi-Zen Peng, Taipei (TW); Chia-Chen Chen, Taipei (TW); Hsin-Shen Chen, Taipei (TW)

(73) Assignees: Inventec (Pudong) Technology Corporation, Shanghai (CN); INVENTEC CORPORATION, Taipei (TW)

( * ) Notice: Subject to any disclaimer, the term of this patent is extended or adjusted under 35 U.S.C. 154(b) by 0 days.

(21) Appl. No.: 17/105,528

(22) Filed: Nov. 26, 2020

(65) Prior Publication Data

US 2022/0074424 A1 Mar. 10, 2022

(30) Foreign Application Priority Data

Sep. 9, 2020 (CN) ..... 202010940969.2

(51) Int. Cl.
*F04D 29/38* (2006.01)
*F04D 29/34* (2006.01)

(52) U.S. Cl.
CPC ..... *F04D 29/384* (2013.01); *F04D 29/34* (2013.01); *F04D 29/388* (2013.01); *F05D 2240/30* (2013.01)

(58) Field of Classification Search
CPC ..... F04D 29/384; F04D 29/34
See application file for complete search history.

(56) References Cited

U.S. PATENT DOCUMENTS 1,827,225 A * 10/1931 Ferreby ..... B64B 1/00 244/30
2016/0290355 A1* 10/2016 Lin ..... F04D 29/023
2019/0128279 A1* 5/2019 Yu ..... F04D 29/424

FOREIGN PATENT DOCUMENTS

CN 209100343 U 7/2019
TW I427220 B 2/2014
TW 201912950 A 4/2019

* cited by examiner

*Primary Examiner* — Michael L Sehn
(74) *Attorney, Agent, or Firm* — CKC & Partners Co., LLC

(57) ABSTRACT

A fan includes a fan hub and a plurality of blades. At least one of the blades includes an axial blade portion and a centrifugal blade portion. The axial blade portion has an axial arc surface. The axial arc surface extends between opposite two edges of the at least one blade, and connects with one of the two edges. The centrifugal blade portion has a guide trench. The guide trench extends away from the centrifugal blade portion. A width of the guide trench increases as it extends away from the centrifugal blade portion.

5 Claims, 5 Drawing Sheets

100

FAN

CROSS-REFERENCE TO RELATED APPLICATION

The present application claims priority to China Application Serial Number 202010940969.2, filed Sep. 9, 2020, which is hereby incorporated reference in its entirety.

BACKGROUND

Technical Field

The present disclosure relates to a fan.

Description of Related Art

With the increased use of ventilation systems, fans and fan systems have become one of the most indispensable tools in life and industry. In response to various fan requirements, the industry has also developed fan systems of different materials and structures.

However, the air volume, wind pressure, and structural strength of the fan should be more improved to approach the needs of various applications.

Therefore, the proposition of a fan that can solve the above problems is one of the goals that the industry urgently wants to solve.

SUMMARY

An aspect of the disclosure is to provide a fan that can efficiently solve the aforementioned problems.

According to an embodiment of the disclosure, a fan includes a fan hub and a plurality of blades. At least one of the blades includes an axial blade portion and a centrifugal blade portion. The axial blade portion connects with the fan hub, which has an axial arc surface that extends between opposite two edges of the blade, and connected to at least one of the opposite two edges. The centrifugal blade portion connects with a side of the axial blade portion that is away from the fan hub, which has a guide trench. The guide trench extends away from the centrifugal blade portion. A width of the guide trench increases as the guide trench extends away from the centrifugal blade portion.

In an embodiment of the disclosure, a dimension of the width of the guide trench is parallel to a rotation axis of the fan hub.

In an embodiment of the disclosure, at least one of the blades has a first side and a second side which are opposite to each other. At least one of the blades further includes a winglet structure. The winglet structure is located at the at least one of the opposite two edges of the blade. The winglet is adjacent to a side of the centrifugal blade portion that is away from the fan hub, and extends from the first side to the second side.

In an embodiment of the disclosure, the winglet structure has a through hole.

In an embodiment of the disclosure, the centrifugal blade portion has an inwardly curved surface. The inwardly curved surface is located at a side of the centrifugal blade portion that is away from the axial blade portion. The inwardly curved surface is a smooth curved surface that is curved inwardly toward the fan hub.

In an embodiment of the disclosure, the fan further includes a plurality of connecting structures. The blades are sequentially connected through the connecting structures to form a ring-shaped assembly.

In an embodiment of the disclosure, the connecting structures are located on the blades respectively. Each of the connecting structures includes a first connecting portion and a second connecting portion. The first connecting portion and the second connecting portion of each of the blades is connected to the second connecting portion of an adjacent one of the blades and the first connecting portion of another adjacent one of the blades respectively.

In an embodiment of the disclosure, the first connecting portion has an extension arm and a hook connected to each other. The second connecting portion has a slot. The hook and the slot of each of the blades are connected to the slot of an adjacent one of the blades and the hook of another adjacent one of the blades respectively.

In an embodiment of the disclosure, the first connecting portion further includes a through hole. The through hole is located on the extension arm. The first connecting portion of each of the blades passes through the through hole of the first connecting portion of an adjacent one of the blades to connect the second connecting portion of the adjacent one of the blades.

From the above detailed description of the specific embodiments of the present disclosure, it can be clearly seen that, in the fan of the present disclosure, the blades includes an axial blade portion having an axial arc surface, which can improve the air volume. Furthermore, the axial blade portion is combined with a centrifugal blade portion having a guide trench, so the air flow and air pressure of the fan can be further increased. In addition, the guide trench can increase the air compression area and decrease the blade pressure, and improve the strength of the blade. The winglet structure and the inwardly curved surface on the blade can decrease the turbulence of the blade and decrease the noise of the fan during operation. By connecting all the blades together through the connecting structures, which a much simpler fan assembly process can be provided to the fan.

It is to be understood that both the foregoing general description and the following detailed description are by examples, and are intended to provide further explanation of the disclosure as claimed.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1A:
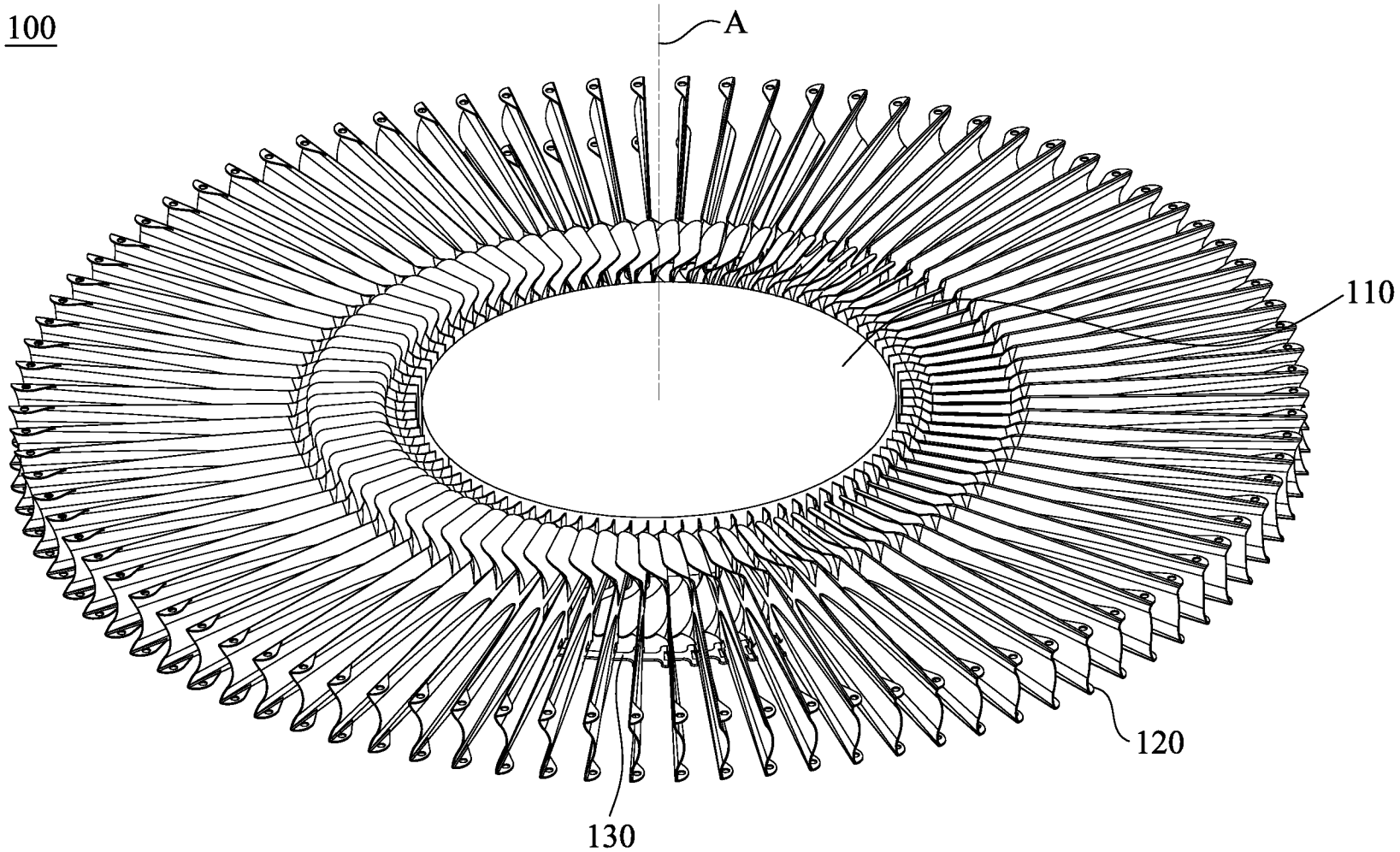
FIG. 1A is a perspective view of a fan after assembly in accordance with some embodiments of the present disclosure.

Hereinafter, a plurality of embodiments of the present disclosure will be disclosed in drawings. For clear description, many practical details will be described in the following description. However, it should be understood that these practical details should not be used to limit the present disclosure. That is, in some embodiments of the present disclosure, these practical details are unnecessary. In addition, in order to simplify the drawings, some conventionally used structures and elements will be shown in a simple schematic manner in the drawings. The same reference numerals will be used to indicate the same or similar elements in all drawings.

Reference is made to FIG. 1A. FIG. 1A is a perspective view of a fan after assembly in accordance with some embodiments of the present disclosure. As shown in FIG. 1A, the fan 100 includes a fan hub 110, a plurality of blades 120, and a plurality of connecting structures 130. The fan has a rotation axis A.

Figure 1B:
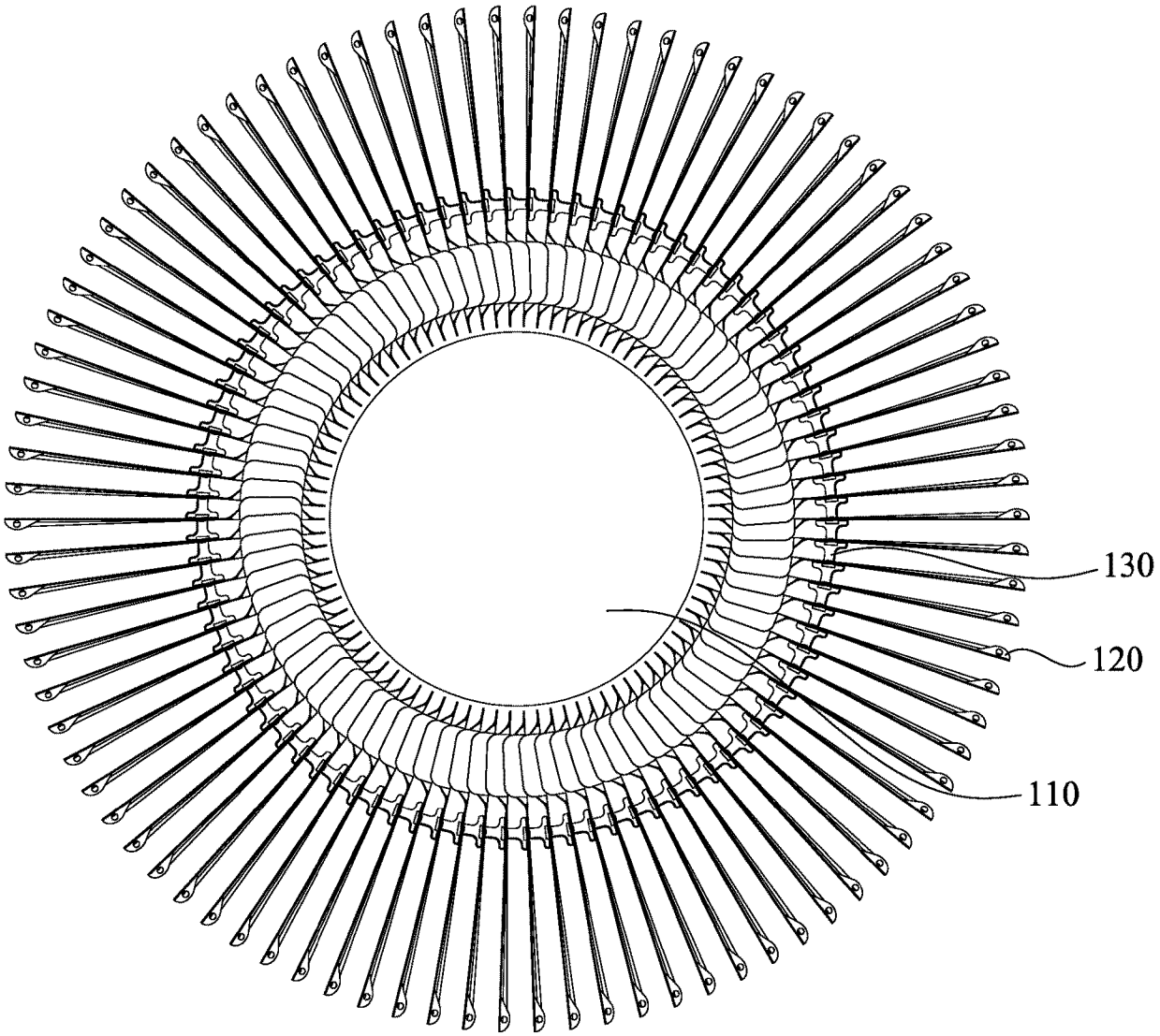
FIG. 1B is a top view of a fan after assembly in accordance with some embodiments of the present disclosure.

Reference is made to FIG. 1B. FIG. 1B is a top view of a fan after assembly in accordance with some embodiments of the present disclosure. As shown in FIG. 1B, all of the blades 120 are sequentially connected to form a ring-shaped assembly through the connecting structures 130. This ring-shaped assembly has a relatively simpler assembly process then the common fan designs.

Figure 2A:
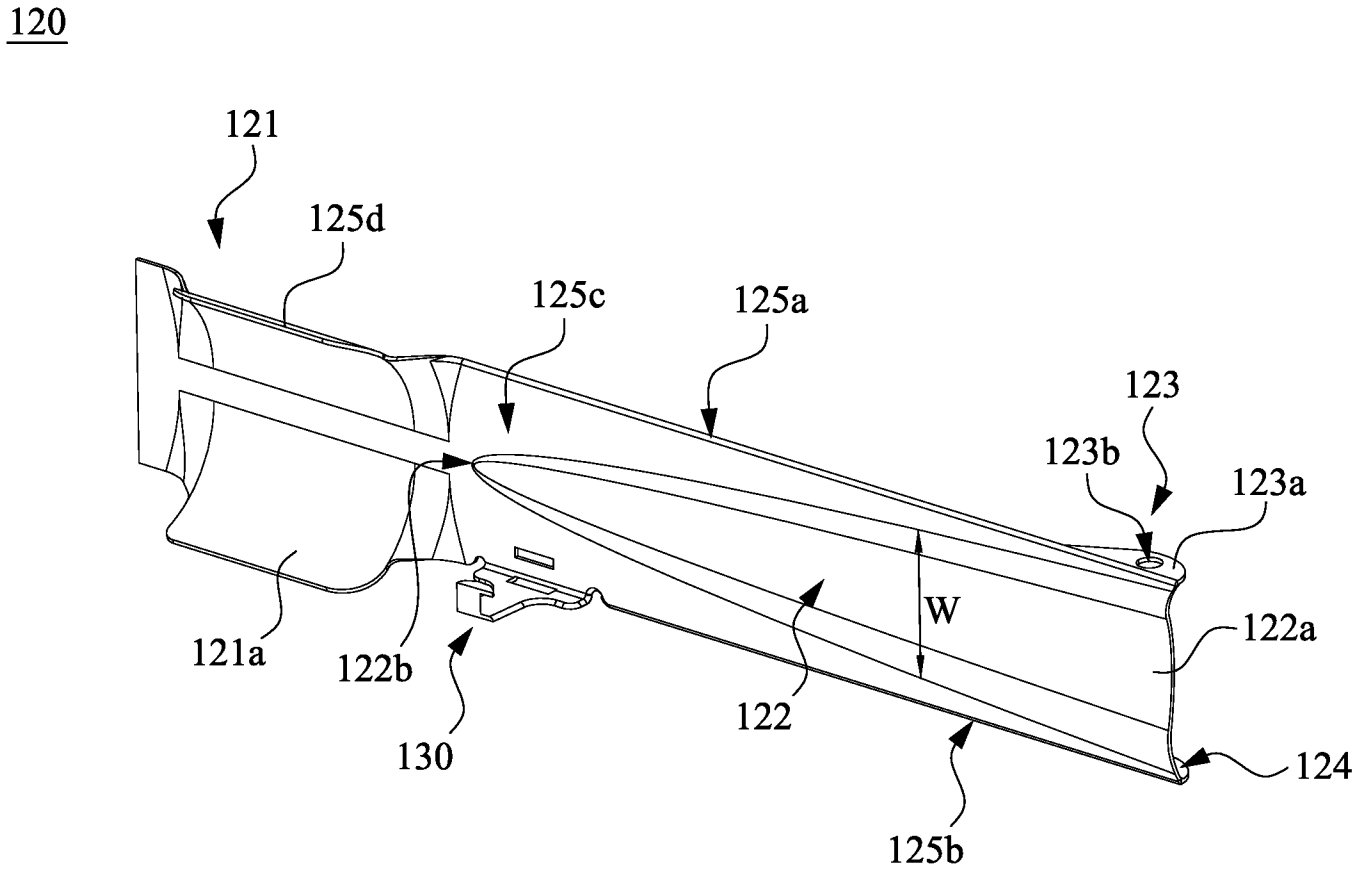
FIG. 2A is a schematic diagram of a blade of a fan in accordance with some embodiments of the present disclosure.

Reference is made to FIG. 2A. FIG. 2A is a three-dimensional view of a blade of a fan in accordance with some embodiments of the present disclosure. As shown in FIG. 2A, one of the embodiments of the blades 120 for the fan 100 is depicted, in which each of the blades 120 includes an axial blade portion 121 and a centrifugal blade portion 122. The blade 120 has two edges 125*a*, 125*b*. In some embodiments, the two edges 125*a*, 125*b* substantially extend along one or more directions that are perpendicular to the rotation axis A, but the present disclosure is not limited to this. The blade 120 has a first side 125*c* and a second side 125*d* that are opposite to each other. For example, when the fan 100 is under operation, the first side 125*c* of the blade 120 is the windward side, and the second side 125*d* is the leeward side. An edge of the axial blade portion 121 is connected to the fan hub 110, and the axial blade portion 121 has at least one axial arc surface 121*a*. The axial arc surface 121*a* extends at least from one of the two edges 125*a*, 125*b*. Specifically, in this embodiment, the axial blade portion 121 has two axial arc surfaces 121*a*, and each of the axial arc surfaces 121*a* are connected to two edges 125*a*, 125*b* respectively, but the present disclosure is not limited to this. In practical applications, the axial blade portion 121 can only have one axial arc surface 121*a* which is connected to one of the two edges 125*a*, 125*b*. Alternatively, the axial arc surface 121*a* is connected to the two edges 125*a*, 125*b* at the same time. The axial arc surface 121*a* tilts from the second side 125*d* to the first side 125*c* of the blade 120. The centrifugal blade portion 122 is connected to a side of the axial blade portion 121 that is away from the fan hub 110. The centrifugal blade portion 122 has a guide trench 122*a*. The guide trench 122*a* extends away from the centrifugal blade portion 122. A width W is increased as the guide trench 122*a* extends away. For example, the dimension of the width W is parallel to the rotation axis A of the fan hub 110. In some embodiments, as shown in FIG. 2A, the guide trench 122*a* has a vertex 122*b* which is located at a side of the centrifugal blade portion 122 that is adjacent to the axial blade portion 121. The guide trench 122*a* is recessed from the first side 125*c* to the second side 125*d* of the blade 120.

As shown in FIG. 2A, in this embodiment, the blade 120 further includes a winglet structure 123. The winglet structure 123 is located at the at least one of the two edges 125*a*, 125*b* of the blade 120 and adjacent to a side of the centrifugal blade portion 122 that is away from the fan hub 110. The winglet structure 123 extends from the first side 125*c* to the second side 125*d* of the blade 120, and forms a flat surface 123*a*. In some embodiments, the flat surface 123*a* substantially extends along a direction that is perpendicular to the rotation axis A of the fan hub 110, but the present disclosure is not limited to this. The flat surface 123*a* has a through hole 123*b* thereon. The shape of the through hole 123*b* can be a circle, a square, a rhombus, a triangle, or other kinds of shape, but the present disclosure is not limited to this.

Figure 2B:
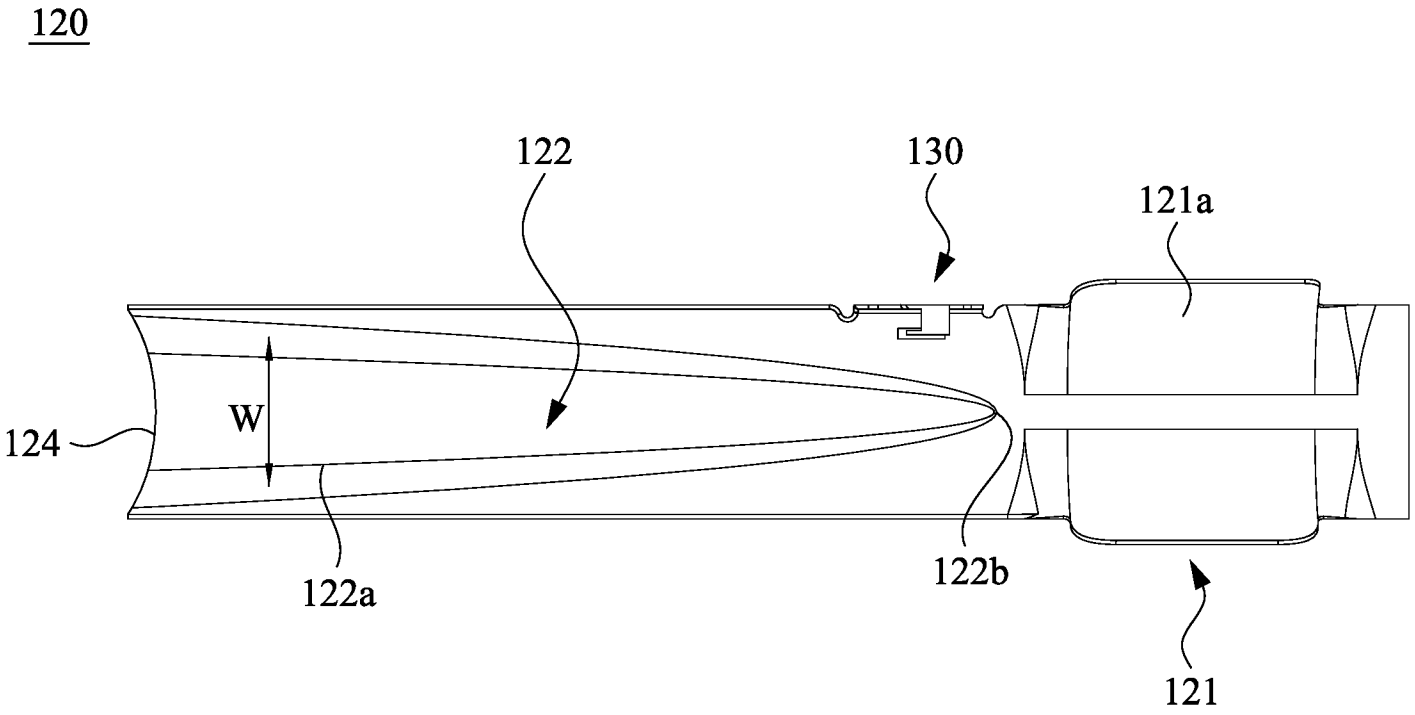
FIG. 2B is a side view of a blade of the fan in FIG. 2A.

Reference is made to FIG. 2B. FIG. 2B is a side view of a blade of the fan in FIG. 2A. As shown in FIG. 2B, the centrifugal blade portion 122 has an inwardly curved surface 124 which is on a side of the centrifugal blade portion 122 that is away from the fan hub 110. The inwardly curved surface 124 is a smooth curved surface. This smooth curved surface 124 is curved inwardly toward the fan hub 110. The so-called "smooth curved surface" indicates a continuous curved surface without a concave and convex shape.

Figure 3:
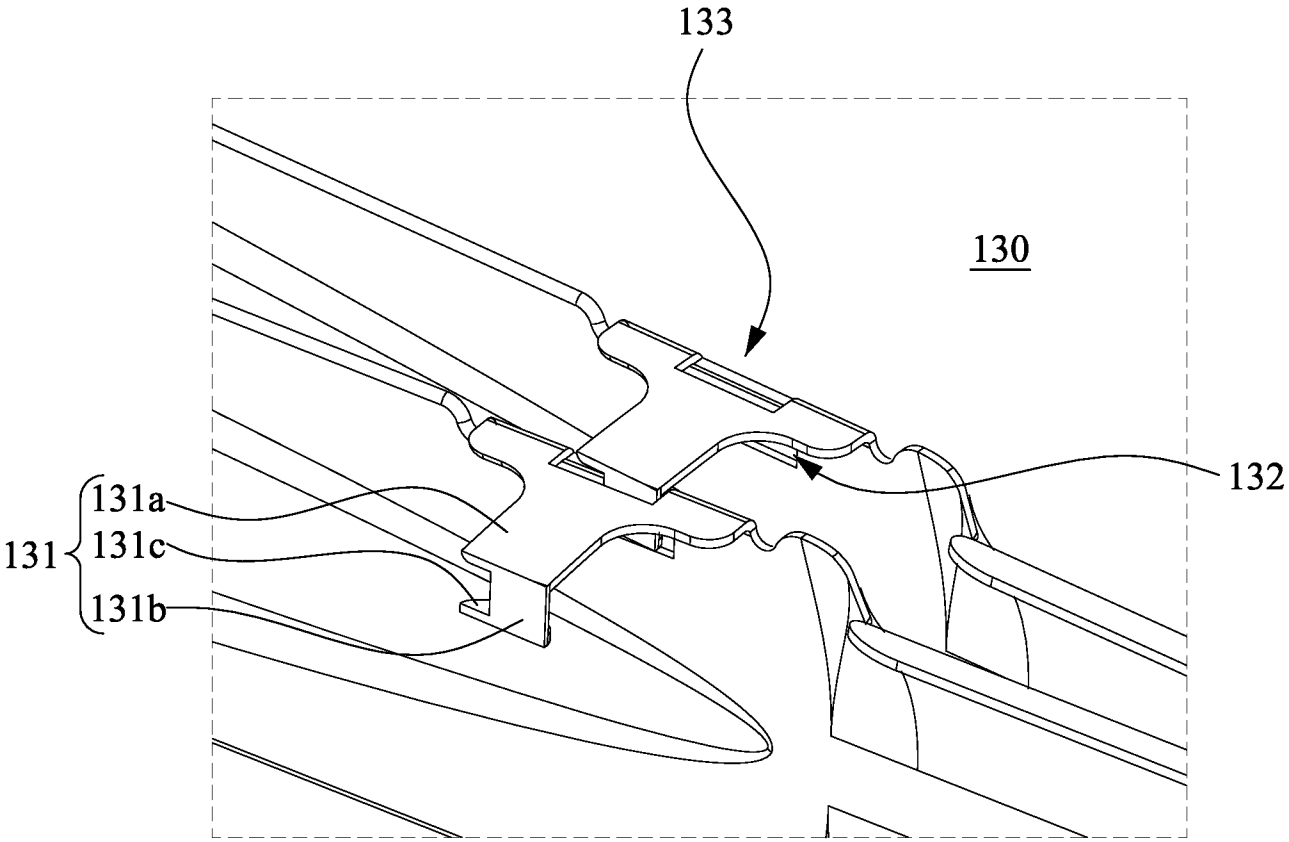
FIG. 3 is an enlarged view of a connecting structure of a blade of a fan in accordance with some embodiments of the present disclosure.

Reference is made to FIG. 3. FIG. 3 is an enlarged view of a connecting structure of a blade of a fan in accordance with some embodiments of the present disclosure. As shown in FIG. 3, a connecting structure 130 includes a first connecting portion and a second connecting portion. In some embodiments, the first connecting portion includes a first extension arm 131*a*, a second extension arm 131*b*, a hook 131*c*, and a through hole 133 which is located on the first extension arm 131*a*. The first extension arm 131*a* extends from one of the two edges 125*a*, 125*b* to the first side 125*c* of the blade 120. The second extension arm 131*b* extends along a direction that is parallel to the rotation axis A of the fan hub 110, from the end of the first extension arm 131*a* to another edge of the two edges 125*a*, 125*b* that is not connected with the first extension arm 131*a*. The hook 131*c* is formed at the end of the second extension arm 131*b*. The second extension arm 131*b* includes a slot 132. The slot 132 is adjacent to the first extension arm 131*a* and one of the two edges 125*a*, 125*b* of the blade 120, and is located on the centrifugal blade portion 122. As shown in FIG. 2A, in some embodiments, the fan 100 further includes a plurality of connecting structures 130. The connecting structure 130 is located on the centrifugal blade portion 122 and adjacent to one of the two edges 125*a*, 125*b* of the blade 120. Referring back to FIG. 3, the first connecting portion of a blade (for example, the blade 120 on the right in FIG. 3) passes through the through hole 133 on the first extension arm 131*a* of an adjacent blade (for example, the blade 120 on the left in FIG. 3) and let the hook 131*c* of this blade 120 engages with the slot 132 of the adjacent blade 120. When the first connecting portion of a blade 120 is engages with the second connecting portion of the adjacent blade 120, the second extension arm 131*b* will abut against the edges of the through hole 133 and limit the displacement of the two blades 120 in the direction that is perpendicular to the rotation axis A of the fan hub 110. The hook 131*c* will abut against the edges of the slot 132 and limit the displacement of the two blades 120 in the direction that is parallel to the rotation axis A of the fan hub 110.

In some embodiments, the blade 120 is formed by a high-strength material, for example, titanium, but the present disclosure is not limited to this. This high-strength material can improve the strength of the blade 120.

In some embodiments, the blade 120 has a thickness equal to or less than 0.1 mm, and the fan 100 can hence have more space between the blades 120. Meanwhile, the fan 100 can have more than 90 blades 120. As such, the air volume and the air flow of the fan 100 during operation can be improved.

From the above detailed description of the specific embodiments of the present disclosure, it can be clearly seen that, in the fan of the present disclosure, the blade includes an axial blade portion having an axial arc surface, which can improve the air volume. Furthermore, the axial blade portion is combined with a centrifugal blade portion having a guide trench, so the air flow and air pressure of the fan can be further increased. In addition, the guide trench can increase the air compression area and decrease the blade pressure and improve the strength of the blade. The winglet structure and the inwardly curved surface on the blade can decrease the turbulence of the blade and decrease the noise of the fan during operation. By connecting all the blades together through the connecting structures, a much simpler fan assembly process can be provided to the fan.

Although the present disclosure has been disclosed in the above embodiments, it is not intended to limit the present disclosure. Anyone who is familiar with the art can make various changes and modifications without departing from the spirit and scope of the present disclosure. The scope of protection of the disclosure shall be subject to the scope of the attached patent application.

What is claimed is:

1. A fan, comprising:

a fan hub;

a plurality of blades, wherein at least one of the blades comprises:

an axial blade portion connected to the fan hub and having an axial arc surface, the axial arc surface being extended between two opposite edges of the blade and connected to at least one of the two edges; and a centrifugal blade portion connected to an end of the axial blade portion that is away from the fan hub and having a guide trench, wherein the guide trench extends away from the centrifugal blade portion, and a width of the guide trench increases as the guide trench extends away from the centrifugal blade portion, and a plurality of connecting structures located on the blades respectively, the blades of the plurality of blades being sequentially connected through the connecting structures to form a ring-shaped assembly, wherein each of the connecting structures comprises a first connecting portion and a second connecting portion, the first connecting portion and the second connecting portion of each of the blades of the plurality of blades is connected to the second connecting portion of an adjacent one of the blades of the plurality of blades and the first connecting portion of another adjacent one of the blades of the plurality of blades respectively, wherein the at least one of the blades has a first side and a second side opposite to each other, the at least one of the blades further comprises a winglet structure, the winglet structure is located at the at least one of the two edges, is adjacent to an end of the centrifugal blade portion that is away from the fan hub, and is extended from the first side to the second side, and wherein the winglet structure has a through hole, wherein the first connecting portion further comprises a through hole, the through hole of the first connecting portion is located on an extension arm of the first connecting portion, and the first connecting portion of each of the blades of the plurality of blades passes through the through hole of the first connecting portion of an adjacent one of the blades of the plurality of blades to connect the second connecting portion of the adjacent one of the blades of the plurality of blades.

2. The fan of claim 1, wherein a dimension of the width of the guide trench is parallel to a rotation axis of the fan hub.

3. The fan of claim 1, wherein the axial arc surface tilts from the second side to the first side, and the guide trench is recessed from the first side to the second side.

4. The fan of claim 1, wherein the centrifugal blade portion has an inwardly curved surface, the inwardly curved surface is located at the end of the centrifugal blade portion that is away from the axial blade portion, and the inwardly curved surface is a smooth curved surface that is inwardly curved toward the fan hub.

5. The fan of claim 1, wherein the first connecting portion has a hook connected to the extension arm, the second connecting portion has a slot, and the hook and the slot of each of the blades of the plurality of blades is connected to the slot of an adjacent one of the blades of the plurality of blades and the hook of another adjacent one of the blades of the plurality of blades respectively.

* * * * *